US010448767B1

(12) United States Patent
Williams

(10) Patent No.: US 10,448,767 B1
(45) Date of Patent: Oct. 22, 2019

(54) SPORTS-THEMED, MODULAR TABLE COVERING

(71) Applicant: Clifton Williams, Brooklyn, NY (US)

(72) Inventor: Clifton Williams, Brooklyn, NY (US)

( * ) Notice: Subject to any disclaimer, the term of this patent is extended or adjusted under 35 U.S.C. 154(b) by 27 days.

(21) Appl. No.: 15/426,156

(22) Filed: Feb. 7, 2017

(51) Int. Cl.
*A47G 11/00* (2006.01)

(52) U.S. Cl.
CPC ..... *A47G 11/006* (2013.01); *A47G 11/004* (2013.01)

(58) Field of Classification Search
CPC ..... A47G 11/006; A47G 11/004
USPC ..... 108/90, 43, 27; 150/158; 428/17, 87, 95
See application file for complete search history.

(56) References Cited

U.S. PATENT DOCUMENTS 3,785,419 A * 1/1974 Sherlock ..... A47G 11/004 108/90
4,389,435 A * 6/1983 Haas, Jr. ..... B32B 5/24 428/17
4,953,193 A * 8/1990 Robinson ..... G03B 42/047 378/162
5,330,806 A * 7/1994 Bythewood ..... A47G 9/062 428/33
5,656,109 A * 8/1997 Schilling ..... D06N 7/0063 156/258
D487,659 S 3/2004 Kerr
D496,802 S 10/2004 Hightower
D632,916 S 2/2011 Pitzer
8,117,971 B1 2/2012 Cotton
8,127,693 B2 3/2012 Edinger
8,522,378 B2 * 9/2013 Argento ..... A47G 9/02 5/482
2004/0081771 A1 * 4/2004 Waterford ..... E01C 13/08 428/17
2005/0158482 A1 * 7/2005 Cook ..... E01C 13/08 428/17
2006/0000393 A1 1/2006 Ka'ahumanu
2006/0207482 A1 9/2006 Bridge
(Continued)

FOREIGN PATENT DOCUMENTS

JP 2007209507 * 8/2007
WO 2006111985 * 10/2006

OTHER PUBLICATIONS https://vetco.net/products/flat-velcro-cable-cover-for-carpet (Year: 2017).*

(Continued)

*Primary Examiner* — Janet M Wilkens

(57) ABSTRACT

The sports-themed, modular table covering is a modular textile that is configured for use with a table. The sports-themed, modular table covering is used as a table cloth. The sports-themed, modular table covering displays a carpet image with a sporting motif. The carpet image is formed as a loop surface that is compatible with hook and loop fastening technology. The loop surface receives an individual interchangeable image selected from a plurality of interchangeable images. Each selected individual interchangeable image is removably attached to the loop surface using a hook and loop fastening technology. Each selected individual interchangeable image is a logo associated with the selected sports motif of the carpet image. The sports-themed, modular table covering comprises an artificial turf carpet and a plurality of interchangeable images. In a second potential embodiment of the disclosure, the sports-themed, modular table covering further comprises a drape.

5 Claims, 3 Drawing Sheets

(56) References Cited

U.S. PATENT DOCUMENTS

| | | | | |
|---|---|---|---|---|
| 2008/0254253 | A1* | 10/2008 | Gallager | A47G 27/0287 428/86 |
| 2009/0044336 | A1* | 2/2009 | Jackson | A47G 9/0207 5/486 |
| 2011/0139041 | A1 | 6/2011 | Pappas | |
| 2012/0180706 | A1 | 7/2012 | Edinger | |
| 2013/0014325 | A1* | 1/2013 | Argento | A47G 9/062 5/417 |
| 2014/0349039 | A1* | 11/2014 | Finell | A47G 11/006 428/33 |
| 2015/0017376 | A1* | 1/2015 | Smith | D06N 7/0063 428/44 |
| 2015/0024150 | A1* | 1/2015 | Vachon | A63C 19/12 428/17 |
| 2015/0337470 | A1* | 11/2015 | Evans, Jr. | D05C 17/02 428/54 |
| 2017/0360191 | A1* | 12/2017 | Jaramillo | A47B 13/083 |

OTHER PUBLICATIONS http://seevanessacraft.com/2014/09/party-easy-football-field-tablecloth/ (Year: 2014).*

* cited by examiner

SPORTS-THEMED, MODULAR TABLE COVERING

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal or domestic articles including furniture such as a table, more specifically, table linen in the form of a table cloth and a multipart table cloth.

SUMMARY OF INVENTION

The sports-themed, modular table covering is a modular textile that is configured for use with a table. The sports-themed, modular table covering is used as a table cloth. The sports-themed, modular table covering displays a carpet image with a sporting motif. The carpet image is formed as a loop surface that is compatible with hook and loop fastening technology. The loop surface receives an individual interchangeable image selected from a plurality of interchangeable images. Each selected individual interchangeable image is removably attached to the loop surface using a hook and loop fastening technology. Each selected individual interchangeable image is a logo associated with the selected sports motif of the carpet image. The sports-themed, modular table covering comprises an artificial turf carpet and a plurality of interchangeable images. In a second potential embodiment of the disclosure, the sports-themed, modular table covering further comprises a drape.

These together with additional objects, features and advantages of the sports themed modular table will be readily apparent to those of ordinary skill in the art upon reading the following detailed description of the presently preferred, but nonetheless illustrative, embodiments when taken in conjunction with the accompanying drawings.

In this respect, before explaining the current embodiments of the sports themed modular table in detail, it is to be understood that the sports themed modular table is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the sports themed modular table.

It is therefore important that the claims be regarded as including such equivalent construction insofar as they do not depart from the spirit and scope of the sports themed modular table. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
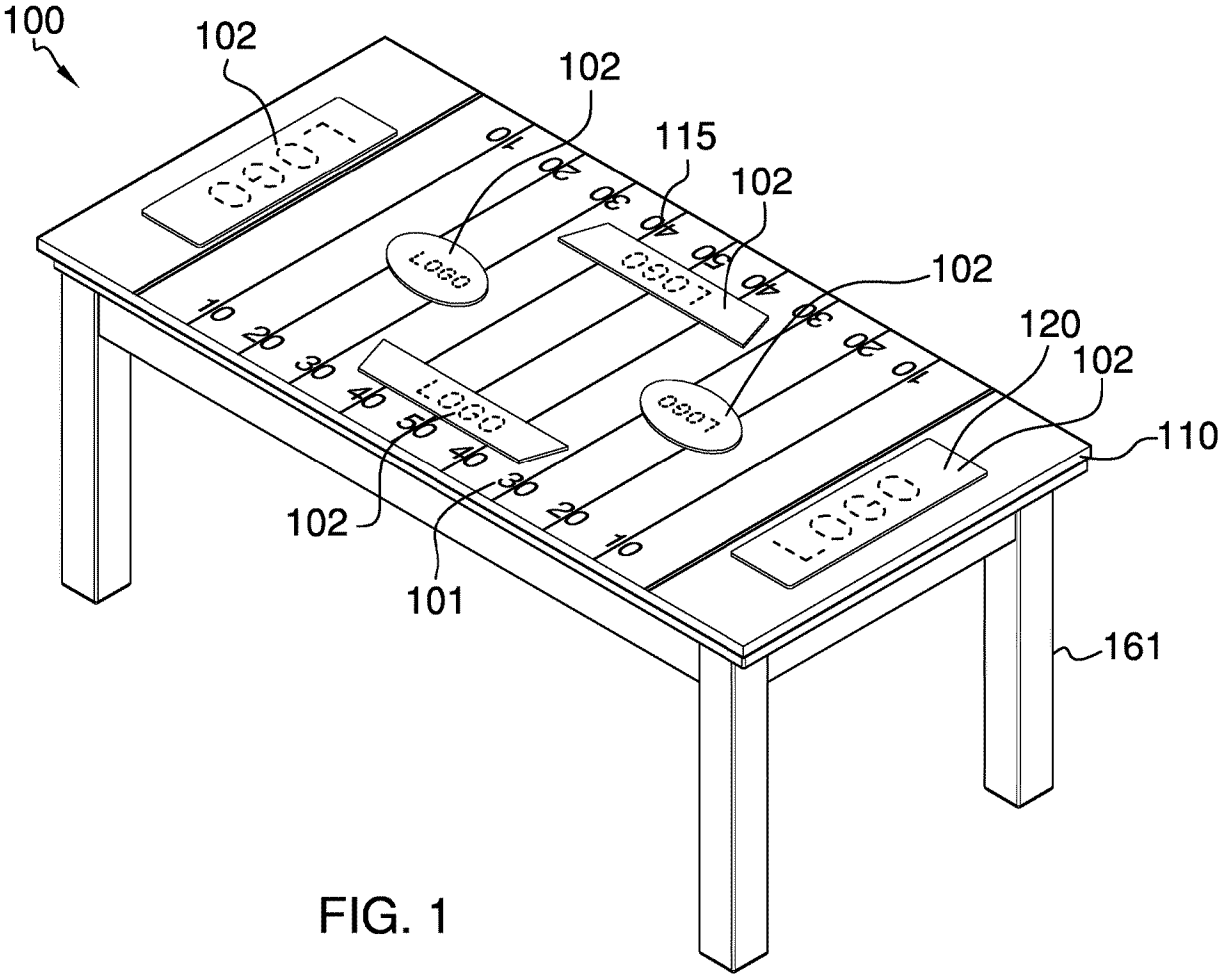
FIG. 1 is a perspective view of an embodiment of the disclosure.
Figure 2:
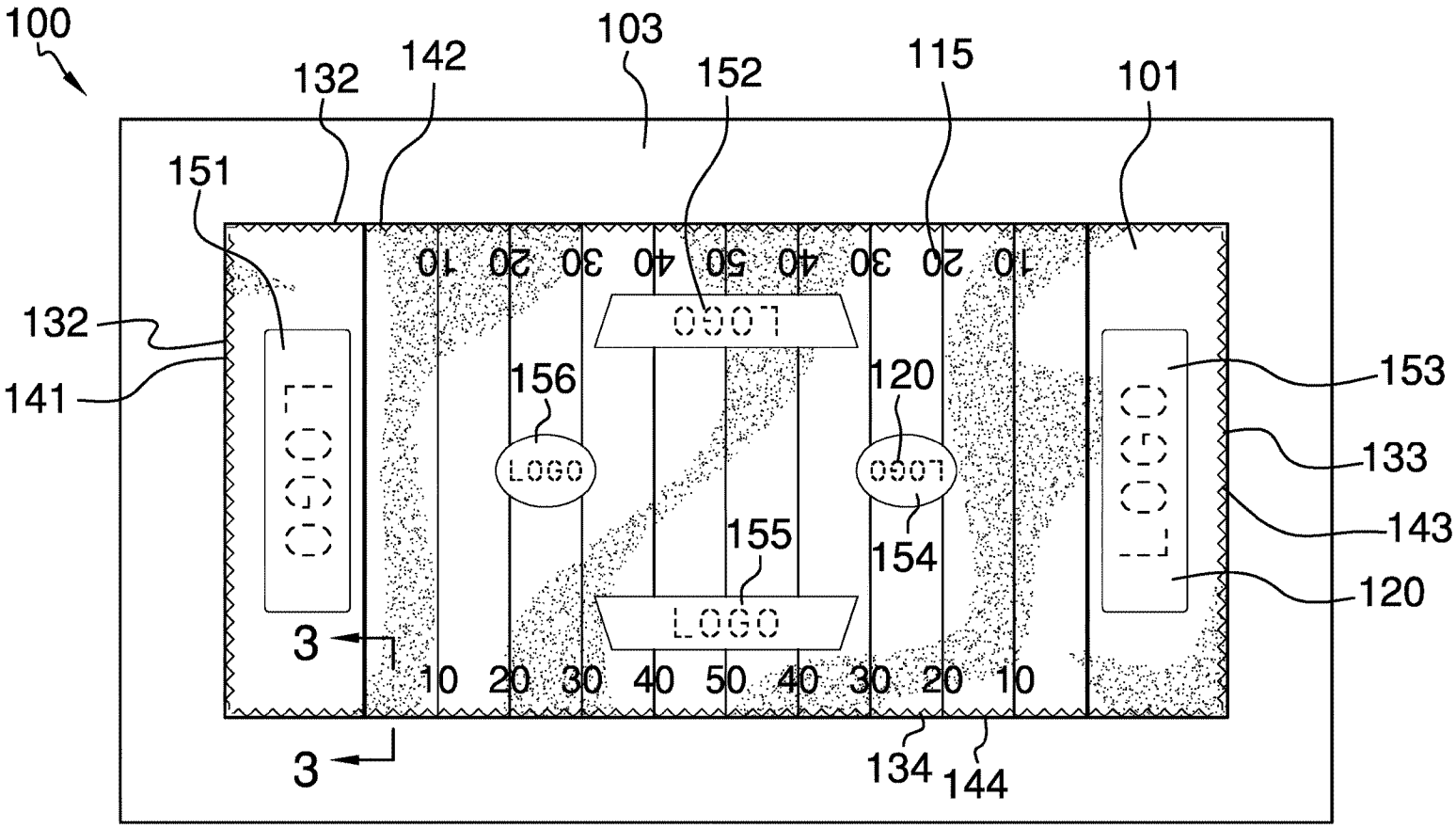
FIG. 2 is a top view of an embodiment of the disclosure.
Figure 3:
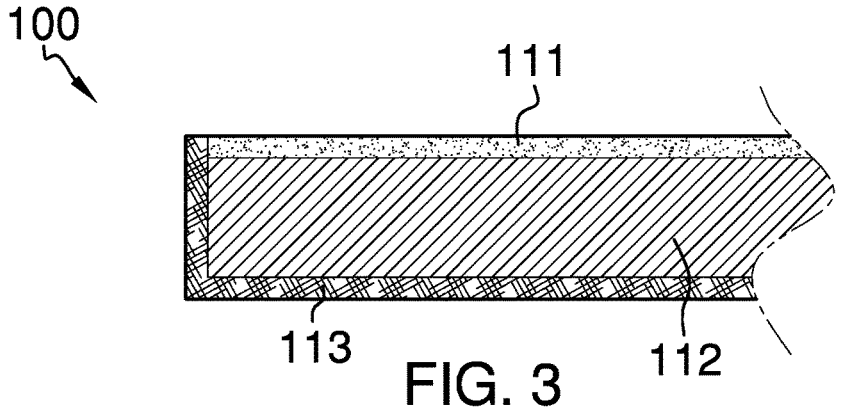
FIG. 3 is a cross-sectional view of an embodiment of the disclosure.
Figure 4:
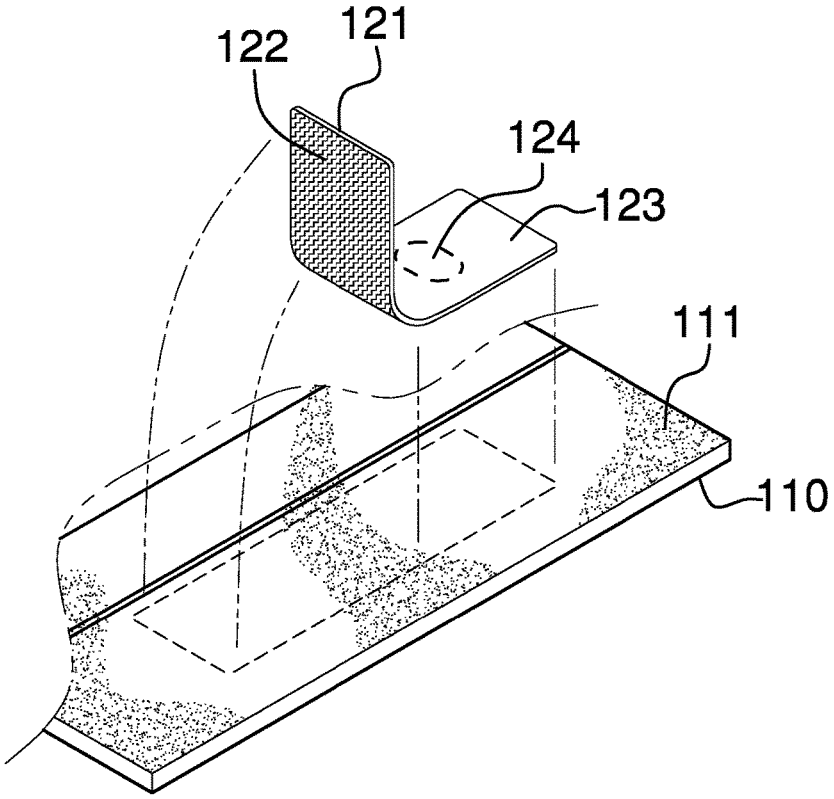
FIG. 4 is a detail view of an embodiment of the disclosure.

Detailed reference will now be made to one or more potential embodiments of the disclosure, which are illustrated in FIGS. 1 through 4.

The sports-themed, modular table covering 100 (hereinafter invention) is a modular textile device that is configured for use with a table 161. The table 161 is a readily and commercially available item of furniture. The invention 100 is used as a table 161 cloth. The invention 100 displays a carpet image 115 with a sporting motif. The carpet image 115 is formed as a loop surface 111 that is compatible with hook and loop fastening technology. The loop surface 111 receives an individual interchangeable image 120 selected from a plurality of interchangeable images 102. Each selected individual interchangeable image 120 is removably attached to the loop surface 111 using a hook and loop fastening technology. Each selected individual interchangeable image 120 is a logo associated with the selected sports motif of the carpet image 115. The invention 100 comprises an artificial turf carpet 101 and a plurality of interchangeable images 102.

The artificial turf carpet 101 is a first composite textile 110 that is formed in the manner of an artificial turf product. The artificial turf carpet 101 is modified in a manner described elsewhere in this disclosure to perform the functions of a loop surface 111 associated with a hook and loop fastener. The artificial turf carpet 101 comprises a first composite textile 110.

The first composite textile 110 is a composite textile structure that is cut in the shape of a rectangle. The design and manufacture of layered composite textiles is well known and documented in the textile arts. The first composite textile 110 comprises a loop surface 111, a padding 112, and a backing 113. The artificial turf carpet 101 is further defined with a first edge 131, a second edge 132, a third edge 133, and a fourth edge 134.

The loop surface 111 is a surface that forms a layer of the first composite textile 110. The loop surface 111 is formed as a tufted carpet surface with the following modification: the cutting of the tufted yarns as performed by the tufting machine is disabled. By not cutting the tufted yarn, the tufted carpet surface forms a plurality of loops that will form a loop surface 111 that will act as the loop surface 111 of a hook and loop fastener.

The padding 112 is a surface that forms a layer of the first composite textile 110. As shown most clearly in FIG. 3, the padding 112 is applied to the face of the loop surface 111 that is distal from the face where the tufted yarns are presented. The backing 113 is a surface that forms a layer of the first composite textile 110. As shown most clearly in FIG. 3, the backing 113 is applied to the face of the padding 112 that is distal from the loop surface 111.

The first composite textile 110 further comprises a carpet image 115. The carpet image 115 is an image that is applied to the loop surface 111 of the first composite textile 110. In the first potential embodiment of the disclosure, the carpet image 115 is drawn from a sports motif.

The carpet image 115 can be formed as a printed image that is applied to the loop surface 111 after the first composite textile 110 has been formed. Printing technologies that apply images to textiles are well known and documented in the textile arts. Alternatively, the carpet image 115 can be formed using existing jacquard tufting technologies in the manufacture of the loop surface 111. The use of jacquard technologies for this purpose are well known and documented in the textile arts.

Each of the plurality of interchangeable images 102 is an image that is removably attached to the loop surface 111 of the first composite textile 110 that forms the artificial turf carpet 101. Each of the plurality of interchangeable images 102 displays the image of a logo that is associated with the overall sport motif associated with the invention 100. The plurality of interchangeable images 102 comprises a collection of individual interchangeable images 120.

The individual interchangeable image 120 displays the image of a logo that is associated with the overall sport motif associated with the invention 100. The individual interchangeable image 120 is a second composite textile 121 that is removably attached to the loop surface 111 of the first composite textile 110. Each of the individual interchangeable image 120 comprises a second composite textile 121. The second composite textile 121 of each individual interchangeable image 120 further comprises a hook surface 122 and a sheeting 123. The sheeting 123 further comprises a customized image 124.

The second composite textile 121 is a layered composite textile. The design and manufacture of layered composite textiles is well known and documented in the textile arts. The hook surface 122 is a readily and commercially available hook surface textile that is commonly used in a hook and loop fastener. The sheeting 123 is a readily and commercially available sheeting material. The sheeting 123 has printed on in a customized image 124 that is displayed on the loop surface 111 when the individual interchangeable image 120 is attached to the loop surface 111. The customized image 124 is a logo that is associated with the sports motif of the invention 100.

The plurality of interchangeable images 102 comprises a first logo textile 151, a second logo textile 152, a third logo textile 153, a fourth logo textile 154, a fifth logo textile 155, and a sixth logo textile 156.

The first logo textile 151 is an individual interchangeable image 120 that contains a customized image 124. The second logo textile 152 is an individual interchangeable image 120 that contains a customized image 124. The third logo textile 153 is an individual interchangeable image 120 that contains a customized image 124. The fourth logo textile 154 is an individual interchangeable image 120 that contains a customized image 124. The fifth logo textile 155 is an individual interchangeable image 120 that contains a customized image 124. The sixth logo textile 156 is an individual interchangeable image 120 that contains a customized image 124.

In a second potential embodiment of the disclosure, the invention 100 further comprises a drape 103.

The drape 103 is a readily and commercially available textile that is cut in the shape of a rectangle. The drape 103 is attached to the artificial turf carpet 101 such that the edges of the drape 103 will drape over the edge of the table 161.

A first seam 141 attaches the first edge 131 of the artificial turf carpet 101 to the drape 103. A second seam 142 attaches the second edge 132 of the artificial turf carpet 101 to the drape 103. A third seam 143 attaches the third edge 133 of the artificial turf carpet 101 to the drape 103. A fourth seam 144 attaches the fourth edge 134 of the artificial turf carpet 101 to the drape 103. In the second potential embodiment of the disclosure, the first seam 141 is a sewn seam. The second seam 142 is a sewn seam. The third seam 143 is a sewn seam. The fourth seam 144 is a sewn seam.

The following definitions were used in this disclosure:

Composite Textile: As used in this disclosure, a composite textile is a multilayer fabric made of two or more joined layers of textile or sheeting materials.

Display: As used in this disclosure, a display is a surface upon which an image is affixed, potentially including, but not limited to, graphic images and text, that is interpretable by an individual viewing the projected image in a meaningful manner.

Hook and Loop Fastener: As used in this disclosure, a hook and loop fastener is a fastener that comprises a hook surface and a loop surface. The hook surface comprises a plurality of minute hooks. The loop surface comprises a surface of uncut pile that acts like a plurality of loops. When the hook surface is applied to the loop surface, the plurality of minute hooks fastens to the plurality of loops securely fastening the hook surface to the loop surface. A note on usage: when fastening two objects the hook surface of a hook and loop fastener will be placed on the first object and the matching loop surface of a hook and loop fastener will be placed on the second object without significant regard to which object of the two objects is the first object and which of the two objects is the second object. When the hook surface of a hook and loop fastener or the loop surface of a hook and loop fastener is attached to an object this will simply be referred to as the "hook or loop surface" with the understanding that when the two objects are fastened together one of the two objects will have a hook surface and the remaining object will have the loop surface.

Image: As used in this disclosure, an image is an optical representation or reproduction of the appearance of something or someone.

Logo: As used in this disclosure, a logo is an image that is typically associated with an organization or activity.

Seam: As used in this disclosure, a seam is a joining of: 1) a first textile to a second textile; 2) a first sheeting to a second sheeting; or, 3) a first textile to a first sheeting. Potential methods to form seams include, but are not limited to, a sewn seam, a heat bonded seam, an ultrasonically bonded seam, or a seam formed using an adhesive.

Sewn Seam: As used in this disclosure, a sewn seam a method of attaching two or more layers of textile, leather, or other material through the use of a thread, a yarn, or a cord that is repeatedly inserted and looped through the two or more layers of textile, leather, or other material.

Sheeting: As used in this disclosure, sheeting is a material, such as a textile, a plastic, or a metal foil, in the form of a thin flexible layer or layers.

Textile: As used in this disclosure, a textile is a material that is woven, knitted, braided or felted. Synonyms in common usage for this definition include fabric and cloth.

With respect to the above description, it is to be realized that the optimum dimensional relationship for the various components of the invention described above and in FIGS. 1 through 4 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A multi-component table linen comprising:

an artificial turf carpet and a plurality of interchangeable images;

wherein the plurality of interchangeable images comprises a collection of individual interchangeable images;

wherein the multi-component table linen is configured for use with a table;

wherein the multi-component table linen is used as a table cloth;

wherein the multi-component table linen displays a carpet image with a sporting motif;

wherein the carpet image is formed as a loop surface that is compatible with hook and loop fastening technology;

wherein the multi-component table linen displays one or more individual interchangeable images;

wherein each selected individual interchangeable image is removably attached to the multi-component table linen;

wherein the artificial turf carpet comprises a first composite textile;

wherein the first composite textile is a composite textile structure that is cut in the shape of a rectangle;

wherein the first composite textile comprises a loop surface, a padding, and a backing;

wherein the padding is sandwiched between the loop surface and the backing;

wherein the loop surface is a surface that forms a layer of the first composite textile;

wherein the loop surface is formed as a tufted carpet surface;

wherein the tufted carpet surface forms a plurality of loops formed by the tufting process;

wherein the plurality of loops are not cut;

wherein the plurality of loops of the tufted carpet surface forms a surface that will act as the loop surface of a hook and loop fastener;

wherein the padding is a surface that forms a layer of the first composite textile;

wherein the padding is applied to the face of the loop surface that is distal from the face where the tufted yarns are presented;

wherein the backing is a surface that forms a layer of the first composite textile;

wherein the backing is applied to the face of the padding that is distal from the loop surface;

wherein the first composite textile further comprises a carpet image;

wherein the carpet image is an image that is applied to the loop surface of the first composite textile;

wherein each of the plurality of interchangeable images is an image that is removably attached to the loop surface;

wherein each individual interchangeable image comprises a second composite textile;

wherein the second composite textile of each individual interchangeable image further comprises a hook surface and a sheeting;

wherein the hook surface is attached to the sheeting;

wherein the hook surface is a hook surface textile used in a hook and loop fastener;

wherein the sheeting further comprises a customized image;

wherein the customized image is printed on the sheeting such that the customized image that is displayed on the loop surface when the individual interchangeable image is attached to the loop surface;

wherein the artificial turf carpet is further defined with a first edge, a second edge, a third edge, and a fourth edge;

wherein the multi-component table linen further comprises a drape;

wherein the drape is a textile that is cut in the shape of a rectangle;

wherein the drape is attached to the artificial turf carpet;

wherein a first seam attaches the first edge of the artificial turf carpet to the drape;

wherein a second seam attaches the second edge of the artificial turf carpet to the drape;

wherein a third seam attaches the third edge of the artificial turf carpet to the drape;

wherein a fourth seam attaches the fourth edge of the artificial turf carpet to the drape;

wherein the first seam is a sewn seam;

wherein the second seam is a sewn seam;

wherein the third seam is a sewn seam;

wherein the fourth seam is a sewn seam.

2. The multi-component table linen according to claim 1 wherein the carpet image is formed as a printed image that is applied to the loop surface after the first composite textile has been formed.

3. The multi-component table linen according to claim 2 wherein the plurality of interchangeable images comprises a first logo textile, a second logo textile, a third logo textile, a fourth logo textile, a fifth logo textile, and a sixth logo textile;

wherein the first logo textile is an individual interchangeable image that contains a customized image;

wherein the second logo textile is an individual interchangeable image that contains a customized image;

wherein the third logo textile is an individual interchangeable image that contains a customized image;

wherein the fourth logo textile is an individual interchangeable image that contains a customized image;

wherein the fifth logo textile is an individual interchangeable image that contains a customized image;

wherein the sixth logo textile is an individual interchangeable image that contains a customized image.

4. The multi-component table linen according to claim 1 wherein the carpet image is formed using jacquard tufting technologies during the manufacture of the loop surface.

5. The multi-component table linen according to claim 4 wherein the plurality of interchangeable images comprises a first logo textile, a second logo textile, a third logo textile, a fourth logo textile, a fifth logo textile, and a sixth logo textile;

wherein the first logo textile is an individual interchangeable image that contains a customized image;

wherein the second logo textile is an individual interchangeable image that contains a customized image;

wherein the third logo textile is an individual interchangeable image that contains a customized image;

wherein the fourth logo textile is an individual interchangeable image that contains a customized image;

wherein the fifth logo textile is an individual interchangeable image that contains a customized image;

wherein the sixth logo textile is an individual interchangeable image that contains a customized image.

* * * * *